US006863744B2

(12) United States Patent
Tsuchiya et al.

(10) Patent No.: US 6,863,744 B2
(45) Date of Patent: Mar. 8, 2005

(54) IRON BASED ALLOY MATERIAL FOR THIXOCASTING PROCESS AND METHOD FOR CASTING THE SAME

(75) Inventors: Masayuki Tsuchiya, Wako (JP); Hiroaki Ueno, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/235,855

(22) Filed: Sep. 6, 2002

(65) Prior Publication Data

US 2003/0049152 A1 Mar. 13, 2003

(30) Foreign Application Priority Data

Sep. 6, 2001 (JP) ..... 2001-270937

(51) Int. Cl.[7] ..... C22C 38/02; C22C 38/34; C22C 37/10; C22C 33/08

(52) U.S. Cl. ..... 148/321; 148/323; 148/538; 164/120

(58) Field of Search ..... 420/9, 117, 99, 420/100; 148/538, 321, 323, 320, 500, 540; 164/113, 119

(56) References Cited

U.S. PATENT DOCUMENTS 5,803,154 A * 9/1998 Sugawara et al. ..... 164/120
6,136,101 A * 10/2000 Sugawara et al. ..... 148/321
6,527,878 B1 * 3/2003 Sugawara et al. ..... 148/321
6,616,777 B1 * 9/2003 Tsuchiya et al. ..... 148/321

FOREIGN PATENT DOCUMENTS

| | | | | |
|---|---|---|---|---|
| EP | 0 779 119 A1 | | 6/1997 | |
| EP | 0 864 662 A1 | | 9/1998 | |
| GB | 2 345 699 A | | 7/2000 | |
| JP | 358034160 | * | 2/1983 | ..... 148/321 |
| JP | 09-239513 | | 9/1997 | |
| JP | WO 00/04198 A | * | 1/2000 | |
| JP | 2000-144304 | | 5/2000 | |
| JP | 2001-123242 | | 5/2001 | |

* cited by examiner

*Primary Examiner*—Deborah Yee
(74) *Attorney, Agent, or Firm*—Arent Fox, PLLC

(57) ABSTRACT

An iron based alloy material for a thixocasting process and a method for casting the material which extends the service life of dies by inhibiting solidification contraction, and in which casting defects such as size variations and cracks can be inhibited. The material comprises 1.6 wt %≦C≦2.5 wt % and 3.0 wt %<Si≦5.5 wt %, and a carbon equivalent (the value of CE) defined as "C(wt %)+⅓Si(wt %)" of 2.9 to 3.5. This material is made to be in a half-melted state with 35 to 50 wt % of a solid phase to be cast under a pressure load.

5 Claims, 3 Drawing Sheets

IRON BASED ALLOY MATERIAL FOR THIXOCASTING PROCESS AND METHOD FOR CASTING THE SAME

BACKGROUND OF THE INVENTION

1. Technical Field

The present invention relates to an iron based alloy material for a thixocasting process and to a method for casting the material.

2. Related Art

Thixocasting processes are methods in which a pressure load is applied to a half-melted billet in a solid-liquid coexisting state to perform injection molding into a die. This method enables the formation of parts with thinner walls and more complicated shapes in comparison with conventional forming methods. In this method, production costs can be reduced due to reduction of machined portions, and thermal load to the die is extremely reduced since the casting can be performed at a lower melting temperature than that in an ordinary diecasting process. Therefore, it has been known that thixocasting processes are promising as method for diecasting materials such as cast iron. However, the liquid phase of cast iron produced by thixocasting processes forms a quenched matrix with low toughness. In iron molding using a high-temperature billet, solidification contraction is greatly when cooling in the die, and cracks are easily formed in the quenched matrix.

In Japanese Patent Unexamined (KOKAI) Publication No. 239513/97, there is proposed a method in which formation of cracks can be suppressed by preventing the formation of chill matrix by using a carbon die. However, the carbon die has insufficient strength and the service life thereof is short, and the production efficiency is reduced due to frequent maintenance of the die. In Japanese Patent Unexamined (KOKAI) Publication No. 123242/01 and Japanese Patent Unexamined (KOKAI) Publication No. 144304/00, there is proposed a method in which formation of cracks can be inhibited by strengthening the quenched matrix by adding chromium or by mixing the quenched matrix with a high toughness phase by increasing the content of manganese. However, the die is worn by friction with a product having a hard quenched matrix during solidification contraction thereof since the solidification contraction in the die still occurs to a great extent. When the wear in the die is promoted, the precision in size of a product at the worn portion is degraded and service life of the die is shortened. When a washing provided on the inner surface of the die is partially stripped by friction with the product, the heat conductivity between the die and the product varies at each portion. As a result, the solidification rate varies at each portion, and this results in casting defects such as size variations and cracks.

SUMMARY OF THE INVENTION

Therefore, an object of the present invention is to provide an iron based alloy material for thixocasting processes and a method for casting the material, in which the service life of the die can be extended by inhibiting solidification contraction and in which casting defects such as size variations and cracks can be inhibited.

The present invention provides an iron based alloy material for a thixocasting process, the material comprising: 1.6 wt %≦C≦2.5 wt %; 3.0 wt %<Si≦5.5 wt %; a carbon equivalent (the value of CE) defined as "C(wt %)+⅓Si(wt %)"; and satisfying 2.9≦(C(wt %)+⅓Si(wt %))≦3.5. The iron based alloy material preferably contains 0.1 wt %≦Cr≦0.3 wt %.

The present invention also provides a method for casting an iron based alloy material for a thixocasting process in which the aforesaid material of the present invention is made to be in a half-melted state with 35 to 50 wt % of a solid phase, to be cast under a pressure load.

The reasons for the aforesaid numerical value limitations and effects are explained hereinafter.

Content of Si: 3.0 wt %<Si≦5.5 wt %

It is possible for the solidification contraction rate in a thin walled part of, for example, about 2.5 mm, to be suppressed to 0.6% or less by reducing the amount of solidification contraction in the case in which the content of Si is limited at more than 3.0 wt %. Therefore, as the abrasion of the molding for the die decreases, preventing damage to the die, the formation of cracks also becomes difficult. From the viewpoint of these effects being well obtained, the lower limit value of the Si content is more than 3.0 wt %, and preferably it is 3.5 wt % or more. In conventional sand molded nodular graphite cast iron, elongation and toughness tend to be remarkably decreased in the case in which the material contains 3.5 wt % or more of Si. However, in a product in which a fixed annealing heat treatment is conducted after casting by using the material of the present invention, sufficient elongation is obtained even if the Si content is more than 3.5 wt %, and in particular, an elongation of 10% or more is ensured with a Si content of 4 wt % or less. At the same time, it is necessary to lower the solid phase rate in order to ensure sufficient fluidity because viscosity in the casting increases by decreasing the content of C when the content of Si is made to increase at the value of CE in any range. Therefore, decrease in the amount of solidification contraction cannot be expected in the case in which the content of Si is 4.5 wt % or more, and there is the possibility that cracks will occur in the molding by lowering the toughness of the matrix even if the solidification contraction rate is small in the case in which the content of Si is 6.5 wt % or more. Furthermore, it is difficult to obtain a molding having a uniform matrix by crystallizing graphite in the molding in the case in which the content of Si is more than 5.5 wt %. Therefore the content of Si is made to be in the range 3.0 wt %<Si≦5.5 wt %.

If the content of Si is in the range of 3.0 wt %<Si≦5.5 wt %, the greater the content of Si, the more a hard passive oxide film composed of $SiO_2$ is formed on the surface of the material when the material before the casting, such as a billet, is heated. Therefore, the material becomes difficult to transform to become easy to handle, and oxidation is also difficult to progress in the heating. Furthermore, the material held on a pallet, etc., is heated by using an induction heating coil or a furnace, and there are cases in which the adhesion of the material and the pallet becomes a problem; however, there is an advantage in that the adhesion is difficult to generate because the hard oxide film on the surface is formed. Equivalent of carbon (the value of CE): 2.9≦the value of CE≦3.5

The amount of the eutectic phase decreases when the value of CE falls less than 2.9, and in the molding in a half-melted state, the resupply of the liquid phase becomes inadequate, so that the filling easily becomes insufficient. In the meantime, the amount of the eutectic phase increases too much when the value of CE exceeds 3.5, and deformation may easily occur when the material is heated in the half-melted state, so that the material becomes difficult to handle. Therefore, there is a possibility that the material will be transformed in the case in which the half-melted material is filled into the die in the molding, and that the oxide film of the surface will contaminate the inside. Therefore, the value of CE is made to be 2.9≦the value of CE≦3.5.

Content of C: 1.6 wt %≦C≦2.5 wt %

The content of C is decided according to the content of Si and the value of CE, and it is made to be 1.6 wt %≦C≦2.5 wt %. However, it is desirable that the content of C be small because a lowering of Young's modulus is caused after the product is heat-treated by annealing after the molding in the case in which the content of C is not small.

Content of Cr: 0.1 wt %≦Cr≦0.3 wt %

Cr is effective as an element which suppresses the crystallization of the graphite in the molding. The aforesaid Si is an element which promotes graphitization, and the graphite crystallizes in the molding in the case in which the content of Si in the composition of the material is 4.0 wt % and in thick walled parts which are difficult to cool rapidly, and the crystallized graphite coarsens when the annealing heat treatment is conducted after the molding in the product, thereby lowering mechanical properties. Furthermore, it is not desirable that the crystallization of the graphite be partially generated because the dimensional accuracy is lowered since the solidification contraction rate in the graphite crystallized parts changes. Then, the addition of Cr is effective, and the crystallization of the graphite cannot be suppressed when the content of Cr is less than 0.1 wt %, and the toughness after the annealing heat treatment is lowered when the content of Cr is more than 0.3 wt %. Therefore, the content of Cr is made to be 0.1 wt %≦Cr≦0.3 wt %.

Solid phase rate: 35 to 50%

With regard to the solid phase rate in the molding of the material, when the value is less than 35%, deformation of the material easily occurs, and the material becomes difficult to handle, whereas when the value is more than 50%, the fluidity is reduced since the solid phase part is too great, and failure to fill the die occurs. Therefore, the solid phase rate in the cast is made to be 35 to 50%.

DETAILED DESCRIPTION OF THE INVENTION

Embodiments of the present invention will be explained hereinafter with reference to the figures to clarify the effects of the invention.

A. Casting Equipment

Figure 1:
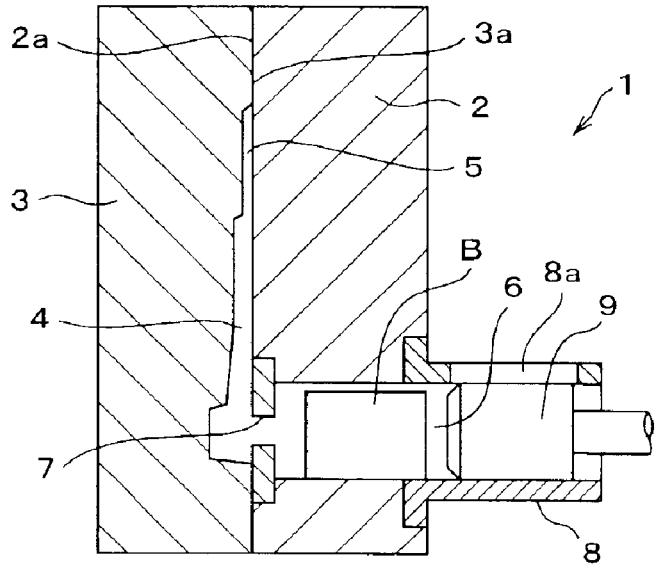
FIG. 1 is a longitudinal sectional view of casting equipment by which pressure load can be conducted which is used in an embodiment of the present invention.
Figure 2A:
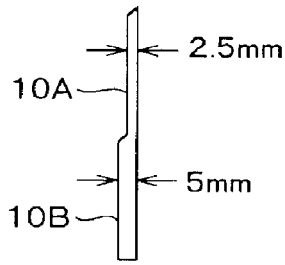
FIG. 2A is a side elevation view of a test piece produced in an embodiment of the present invention.
Figure 2B:
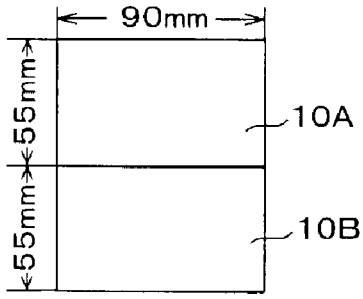
FIG. 2B is a front view of a test piece produced in an embodiment of the present invention.

FIG. 1 is a longitudinal sectional view of casting equipment by which pressure load can be conducted in order to cast a thin plate-shaped test piece which has two thicknesses which change stepwise as shown in FIGS. 2A and 2B. The pressure load type of casting equipment 1 comprises a fixed die 2 and a movable die 3 which are both made of copper and which have perpendicular matching planes 2*a* and 3*a* matching each other, a runner 4 and cavities 5 in which test pieces are formed between the two perpendicular matching planes 2*a* and 3*a*. A chamber 6 which accommodates billet B as the cast material is formed in the fixed die 2, and the chamber 6 runs to the runner 4 by way of the gate 7. Furthermore, sleeve 8 which runs to the chamber 6 is installed horizontally in the fixed die 2, and plunger 9 which is inserted in the chamber 6 is fit horizontally in the sleeve 8 so as to freely slide. Then, billet B is filled in the cavities 5 from the runner 4 by placing the billet B in the half-melted state in the sleeve 8 from insertion mouth 8*a* formed at an upper part of the impounding dike in sleeve 8, and by moving the plunger 9 horizontally in a direction of the movable die 3.

B.Test Piece

A test piece molded in cavity 5 in the aforesaid pressure load type of the casting equipment 1 is 90 mm in width and 110 mm in height as is shown in FIGS. 2A and 2B, and is a thin plate with two thicknesses which change stepwise in which there is a thin walled part 10A 2.5 mm in thickness extending from half way in the height direction to one end (upper parts of FIGS. 2A and 2B) and a thick walled part 10B 5 mm in thickness extending from half way in the height direction to the other end (lower parts of FIGS. 2A and 2B).

C. Casting Test

Iron based alloys of embodiments 1 to 5 and comparative examples 1 to 5 with C contents, Si contents and Cr contents as shown in Table 1 were used as materials in the following test, cylindrical billets 50 mm in diameter and 65 mm long were made of these materials, and these were heated inductively. The conditions of the heating were as follows: temperature and solid phase rate at which the billet was filled into the part 2.5 mm in thickness of the aforesaid cavity 5 by measuring the internal temperature in the 5 mm depth from the end face of the billet were properly set. The heating conditions are given in Table 1. The heated billets were cast under a pressure load by using the pressure load type of casting equipment 1 shown in FIG. 1, and the test pieces were molded. The pressurization force in the cast was 70 MPa, preheating temperature in the dies 2 and 3 was 200° C., and the test pieces were taken out by opening the dies 2 and 3 after a holding time of 1 second.

TABLE 1

| | C content wt % | Si content wt % | Cr content wt % | Value of CE | Billet heating conditions: Temperature in heating ° C. | Billet heating conditions: Solid phase rate % | Amount of solidification contraction % | Elongation % | Crystallization of graphite | Notes |
|---|---|---|---|---|---|---|---|---|---|---|
| embodiment | | | | | | | | | | |
| 1 | 2.1 | 3.1 | — | 3.1 | 1210 | 48 | 0.57 | 16.5 | none | |
| 2 | 2 | 3.6 | — | 3.2 | 1220 | 41.8 | 0.46 | 13.8 | none | |
| 3 | 1.9 | 4 | 0.1 | 3.2 | 1220 | 43.2 | 0.40 | 12.4 | none | |
| 4 | 1.8 | 4.5 | 0.2 | 3.3 | 1220 | 42.4 | 0.34 | 7.3 | none | |
| 5 | 1.6 | 5.5 | 0.3 | 3.4 | 1220 | 37.7 | 0.41 | 2.1 | none | |
| comparative example | | | | | | | | | | |
| 1 | 3.3 | 0.8 | — | 3.6 | 1170 | 30.1 | 0.88 | | none | contamination by oxide film |
| 2 | 2.8 | 0.7 | — | 3.0 | 1170 | 54.5 | 0.84 | | none | |
| 3 | 2.3 | 2 | — | 3.0 | 1200 | 54.6 | 0.68 | | none | |
| 4 | 2.2 | 2.5 | — | 3.0 | 1210 | 43.7 | 0.63 | | none | |
| 5 | 1.4 | 6.5 | 0.05 | 3.6 | 1230 | 29.3 | 0.46 | | present | cracks in molding |

Figure 3:
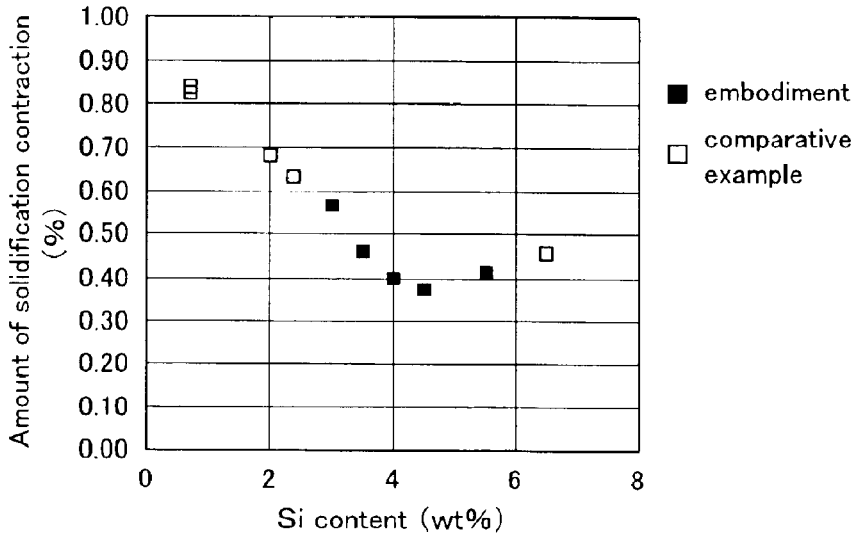
FIG. 3 is a graph showing the results of the amount of solidification contraction in an embodiment of the present invention and in a comparative example.

The amount of solidification contraction was obtained by measuring the width of the thin walled part 10A in the test pieces of embodiments 1 to 5 and comparative examples 1 to 5 which were molded in the above manner. Furthermore, the internal texture of the thick walled part 10B of the as-cast condition was observed after polishing by a microscope, and the existence of crystallization of graphite was examined. These results are given in Table 1, and the results of the amounts of solidification contraction are shown in FIG. 3.

D. Tensile Test

For the test pieces of embodiments 1 to 5, an annealing heat treatment was conducted in which the test pieces were cooled in a furnace after they were retained at 950° C. for 60 minutes. Afterwards, the tensile test pieces having the tensile test parts 6 mm in width and 27 mm in parallel parts were cut down from the thick walled part 10B. The elongations of these tensile test pieces were measured by conducting the tensile tests. The measurement results are given in Table 1.

E. Result of the Casting Test

In embodiments 1 to 5 based on this invention, the amounts of solidification contraction are less than 0.6% in any of the embodiments, and this value is equivalent to or less than the value in diecasting products composed of aluminum. Therefore, it can clearly prevent damage such as abrasion of the die. Furthermore, the oxide film on the surface of the billet was trapped at the gate, and so the contamination of the test piece by the oxide film was not observed because the billet was transformed so as not to collapse when the billet was put into the sleeve.

In addition, in the comparative example 1 among comparative examples 1 to 5 which are outside the scope of the present invention, there were large amount of the eutectic phase since the CE value was high, so the billet was easily transformed in the heating. Therefore, the billet collapsed when the billet was put into the sleeve, and the oxide film on the surface of the billet passed the gate to contaminate the test piece, and therefore cracks and cold shuts arose on the surface of the test piece. Although the defects concerned with the filling of the material in the comparative examples 2 to 4 were not observed, it was clear that the amount of solidification contraction was large and 0.6% or more, damage such as abrasion to the die occurred, and cracks were easily generated in the product. Although the filling was not insufficient in the comparative example 5 with the large content of Si and the amount of solidification contraction was also small, cracks were generated at the step part of the boundary between the thin walled part and the thick walled part because of low toughness.

F. Results of Tensile Tests

Judging from the tensile tests conducted on embodiments 1 to 5, it was clear that the greater the content of Si, the more the elongation tended to decrease; however sufficient elongation was obtained even if the content of Si exceeded 3.5 wt %.

G. Results of Examination of the Matrix

Figure 4:
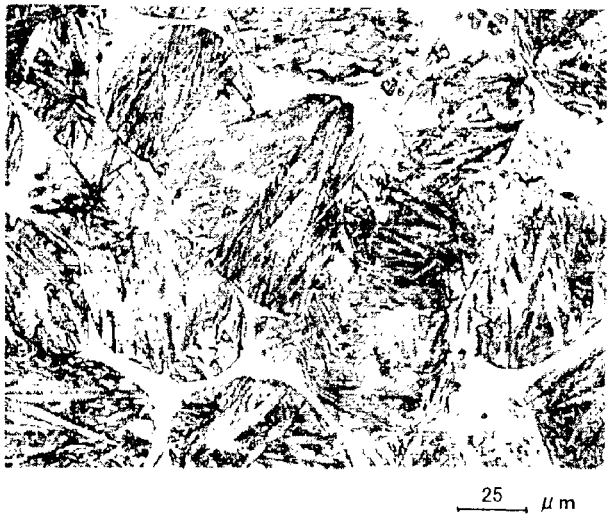
FIG. 4 is a photomicrograph showing the internal texture of a material in an embodiment of the present invention.
Figure 5:
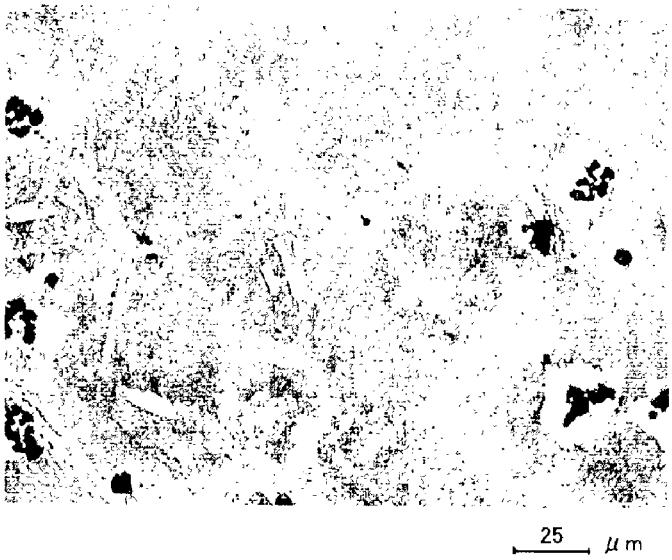
FIG. 5 is a photomicrograph showing the internal texture of a material in a comparative example to be compared to an embodiment of the present invention.

FIG. 4 is a photomicrograph of the matrix in embodiment 4, and FIG. 5 is a photomicrograph of the matrix in comparative example 5. It is clear that the matrix in embodiment 4 is uniform and sound; however, in comparative example 5, crystallization (black part) of the graphite is confirmed in parts. Therefore, it is believed that mechanical properties after annealing heat treatment and dimensional accuracy when the solidification contraction rate changes, etc., will be reduced in comparative example 5.

What is claimed is:

1. A method for casting an iron based alloy material for a thixocasting process, the method comprising: providing an iron based alloy material for a thixocasting process, the material comprising:

1.6 wt %≦C≦2.5 wt %;

3.0 wt %<Si≦5.5 wt %; and a carbon equivalent (the value of CE) defined as "C(wt %)+⅓Si(wt %)"; and satisfying 2.9≦(C(wt %)+⅓Si(wt %))≦3.5, in a half-melted state with 35 to 50 wt % of a solid phase; and diecasting the metal.

2. A method for casting an iron based alloy material for a thixocasting process, the method comprising: providing an iron based alloy material for a thixocasting process, the material comprising:

1.6 wt %≦C≦2.5 wt %;

3.0 wt %<Si≦5.5 wt %;

0.1 wt %≦Cr≦0.3 wt %; and a carbon equivalent (the value of CE) defined as "C(wt %)+⅓Si(wt %)"; and satisfying 2.9≦(C(wt %)+⅓Si(wt %))≦3.5;

in a half-melted state with 35 to 50 wt % of a solid phase; and diecasting the metal.

3. An iron based alloy material for a thixocasting process, the material comprising:

1.6 wt %≦C≦2.5 wt %;

3.0 wt %<Si≦5.5 wt %; and a carbon equivalent (the value of CE) defined as "C(wt %)+⅓Si(wt %)"; and satisfying 2.9≦(C(wt %)+⅓Si(wt %))≦3.5;

wherein the iron based alloy material is in a half-melted state with 35% to 48 wt % of a solid phase.

4. A method for casting an iron based alloy material for a thixocasting process, the method comprising: providing an iron based alloy material for a thixocasting process, the material comprising:

1.6 wt %≦C≦2.5 wt %;

3.0 wt %<Si≦5.5 wt %; and a carbon equivalent (the value of CE) defined as "C(wt %)+⅓Si(wt %)"; and satisfying 2.9≦(C(wt %)+⅓Si(wt %))≦3.5, in a half-melted state with 35 to 48 wt % of a solid phase; and diecasting the metal.

5. A method for casting an iron based alloy material for a thixocasting process, the method comprising: providing the materials recited in claim 1 in a half-melted state with 35 to 48 wt % of a solid phase; and diecasting the metal.

* * * * *